US005881941A

United States Patent [19]

Lai

[11] Patent Number: 5,881,941

[45] Date of Patent: Mar. 16, 1999

[54] STAPLER HAVING A SILENCER

[75] Inventor: Mei-Ling Lai, Taichung, Taiwan

[73] Assignee: Basso Industry Corp., Taichung, Taiwan

[21] Appl. No.: 880,550

[22] Filed: Jun. 23, 1997

[51] Int. Cl.[6] ..... B25C 1/04; F01N 1/06

[52] U.S. Cl. ..... 227/130; 181/230

[58] Field of Search ..... 227/8, 10, 130; 173/DIG. 2; 181/230

[56] References Cited

U.S. PATENT DOCUMENTS 3,255,844 6/1966 Wallace ..... 181/230
5,432,307 7/1995 Maurer ..... 181/230
5,500,494 3/1996 Ligman ..... 181/230
5,676,300 10/1997 Nakazato et al. ..... 227/130

*Primary Examiner*—Stephen F. Gerrity
*Attorney, Agent, or Firm*—Charles E. Baxley, Esq.

[57] ABSTRACT

A stapler cover includes an outlet for allowing pressurized air to flow out of the stapler cover. A silencing member is disposed close to the outlet for engaging with the pressurized air and for silencing the pressurized air flowing through the outlet. The silencing member includes a coil spring and the cover includes one or more stop members for engaging with the coil spring and for retaining the coil spring in place. A wire is engaged through the coil spring for retaining the coil spring in place.

5 Claims, 7 Drawing Sheets

STAPLER HAVING A SILENCER

BACKGROUND OF THE INVENTION

1. Field of the Invention

The present invention relates to a stapler, and more particularly to a stapler having a silencer for decreasing the noise of the exhaust air.

2. Description of the Prior Art

Typical staplers are driven by pressurized air which will generate great noise when the pressurized air flows out of the stapler. No silencer has been provided for reducing the noise.

The present invention has arisen to mitigate and/or obviate the afore-described disadvantages of the conventional staplers.

SUMMARY OF THE INVENTION

The primary objective of the present invention is to provide a stapler which includes a silencer for reducing the noise of the exhaust air.

In accordance with one aspect of the invention, there is provided a stapler cover comprising a cover body including an outlet for allowing pressurized air to flow out of the cover body of the stapler cover, and means for silencing the pressurized air flowing through the outlet.

The cover body includes a plurality of openings, and a cap secured to the cover body, the outlet is formed in the cap, the silencing means is disposed between the openings and the outlet and includes a plurality of apertures for allowing the pressurized air to flow through the outlet and for silencing the pressurized The silencing means includes a coil spring. The cover body includes at least one stop member engaged with the coil spring and for retaining the coil spring in place. A wire is engaged through the coil spring for retaining the coil spring in place.

The silencing means includes a coil spring disposed in the outlet and includes a rod secured in the cover body for engaging with the coil spring and for retaining the coil spring in place. The rod is engaged through the coil spring.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
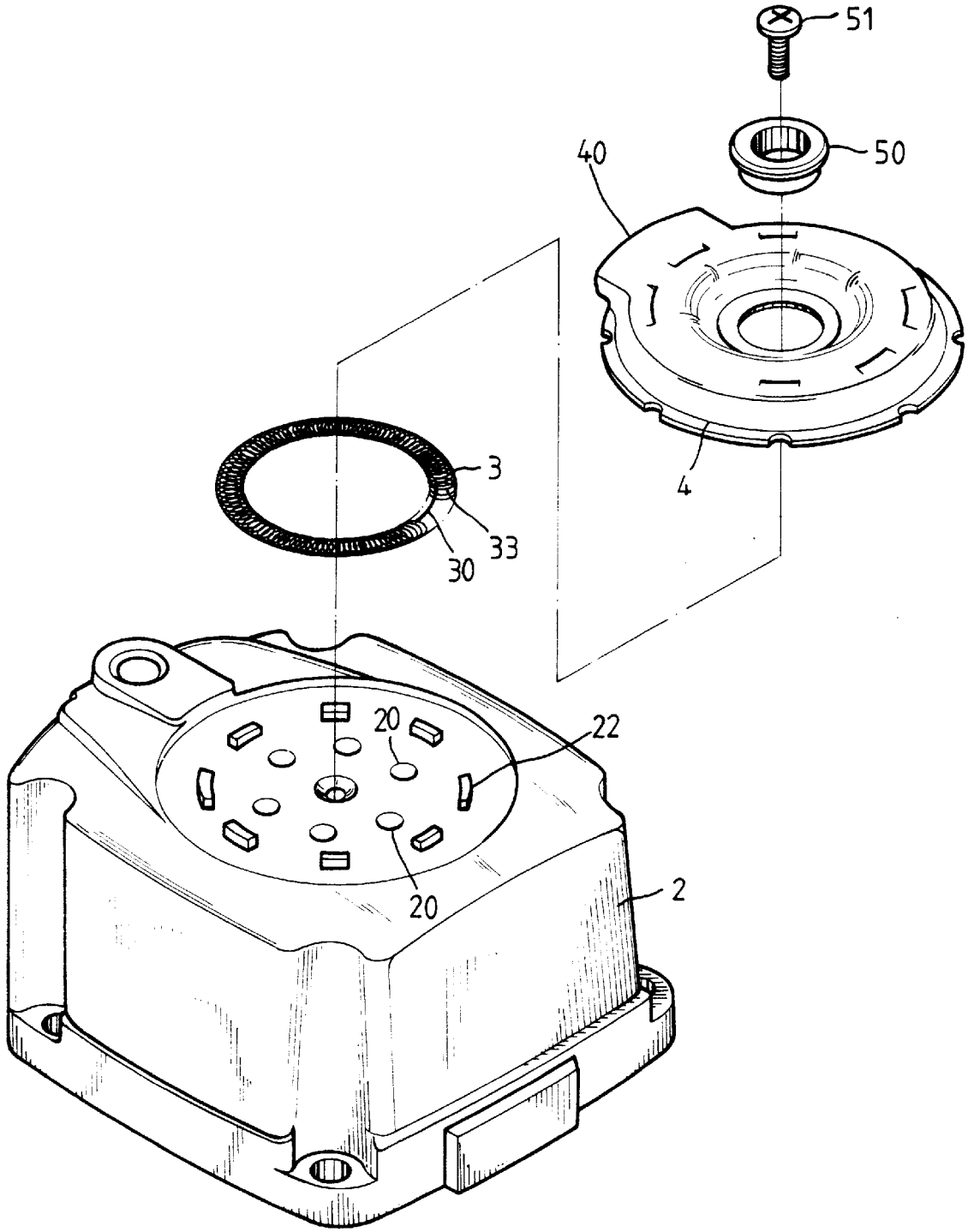
FIG. 1 is an exploded view of a silencer for a stapler in accordance with the present invention.
Figure 2:
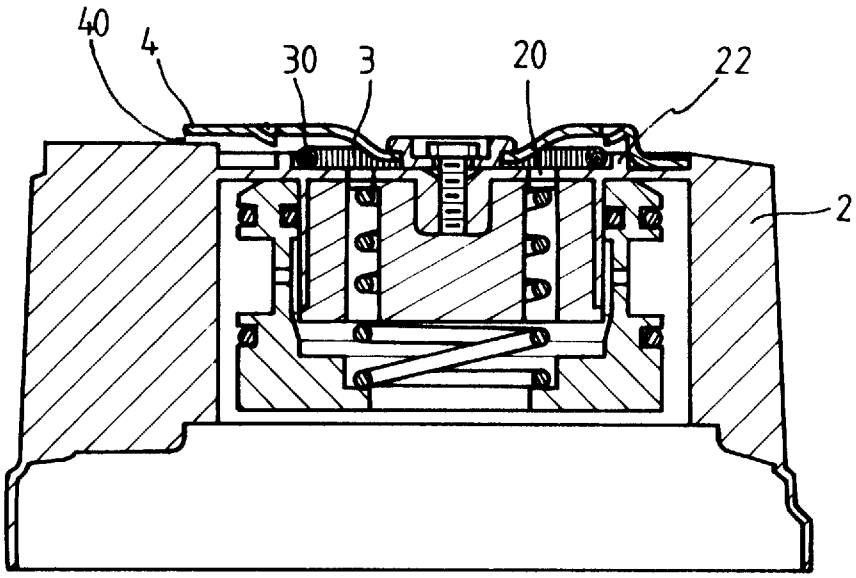
FIG. 2 is a cross sectional view of the silencer.
Figure 3:
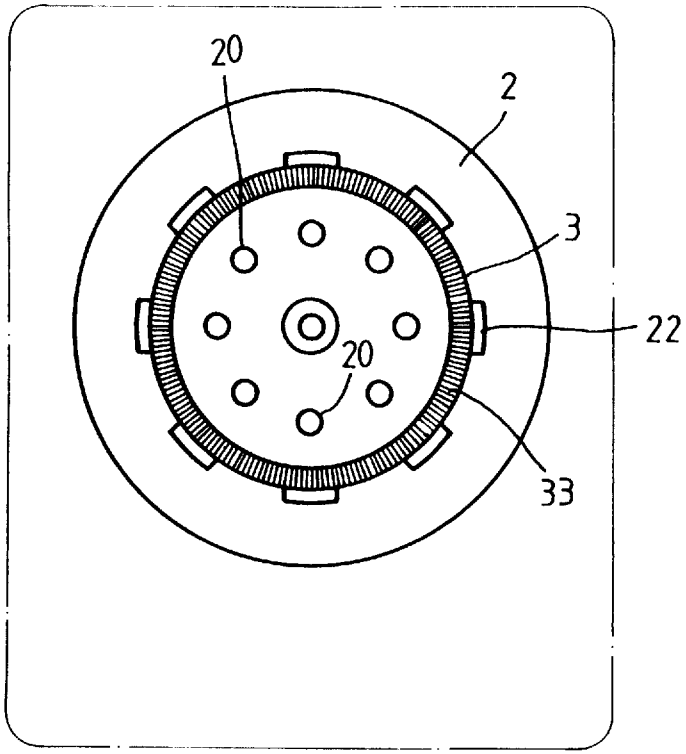
FIG. 3 is a plane view showing the application of the silencer.

Referring to the drawings, and initially to FIGS. 1–3, a silencer in accordance with the present invention is provided for attaching to an end cover 2 of a stapler. In which, the configuration of the stapler is not related to the present invention and has not been shown completely. The cover 2 comprises a number of openings 20 for allowing pressurized air to flow out of the cover 2 and includes a number of stops 22 spaced away from each other and arranged in a circular shape. The present invention is to provide a silencer 3 engaged with the stops 22 and engaged around the openings 20. The silencer 3 is preferably a body having a number of apertures 33 or preferably a coil spring having a wire 30 engaged through the coil spring for retaining the coil spring in a circular shape. A cap 4 is secured on top of the cover 2 with a washer 50 and a fastener 51, for securing the silencer 3 in place. The cap 4 includes an outlet 40 for allowing the pressurized air from the openings 20 to flow out of the cap 4. The silencer 3 is arranged between the openings 20 and the outlet 40 for engaging with the pressurized air and for reducing the noise that may be generated by the pressurized air.

In operation, the pressurized air flowing out of the openings 20 may flow through the apertures 33 of the silencer 3 before flowing out of the outlet 40 of the cap 4, such that the silencer 3 may be used for reducing the noise that may be generated by the pressurized air.

Figure 4:
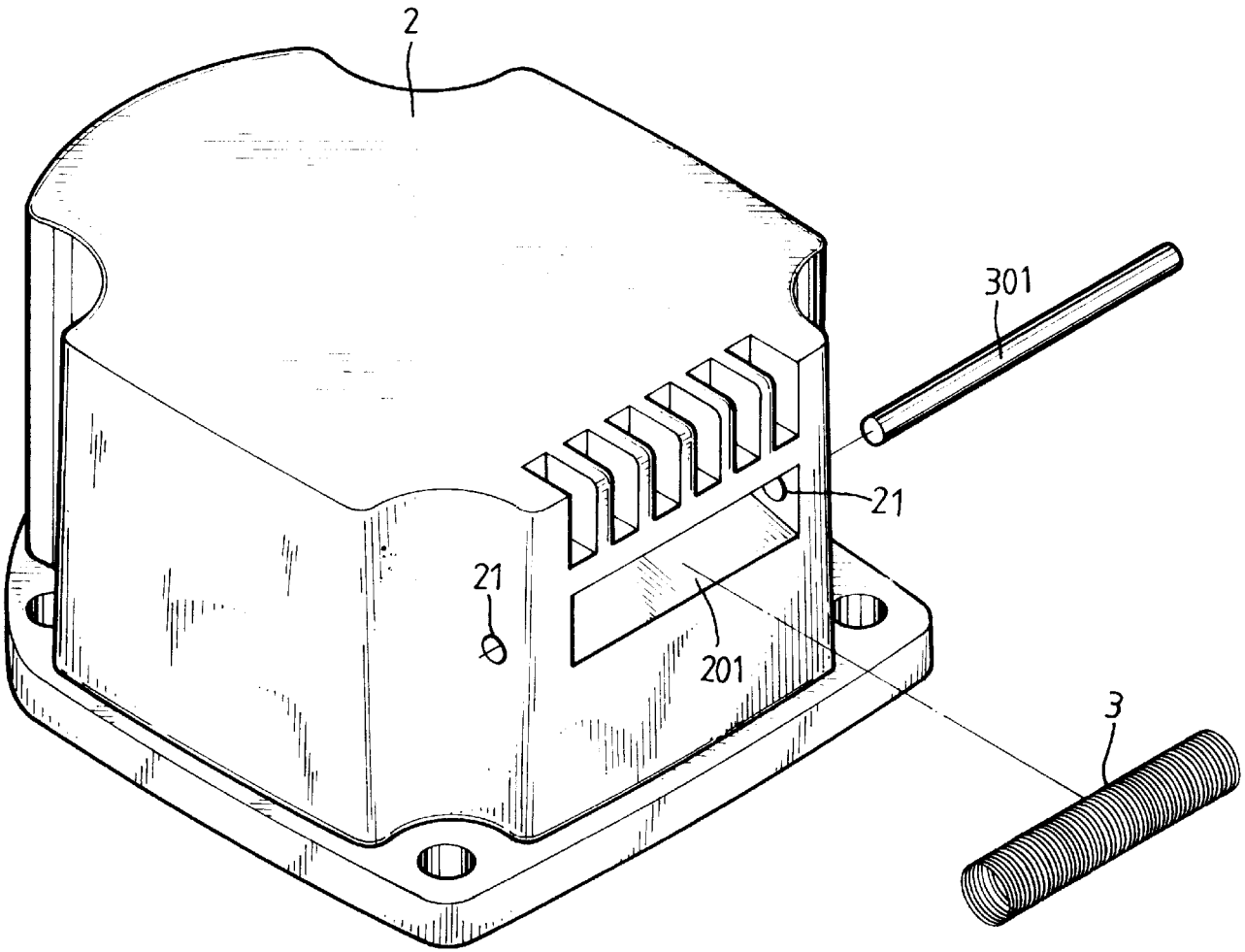
FIG. 4 is an exploded view showing another application of the silencer.
Figure 5:
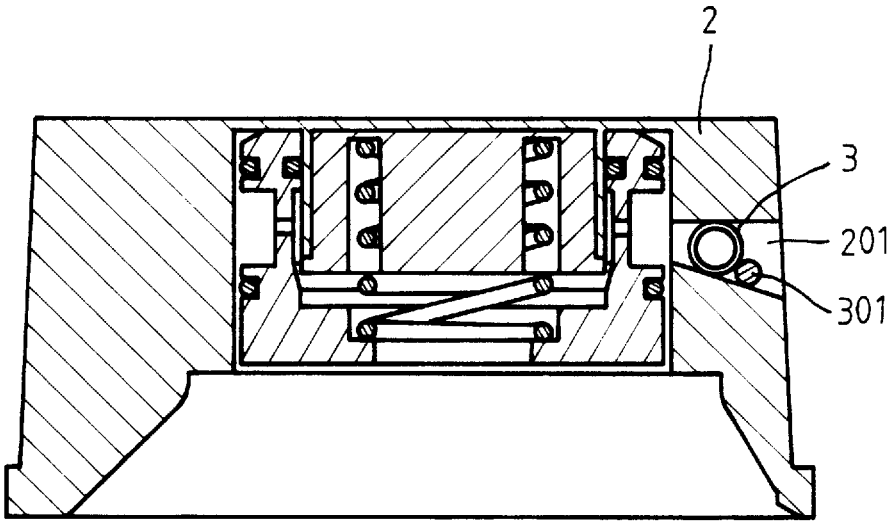
FIG. 5 is a cross sectional view of the silencer as shown in FIG. 4.
Figure 6:
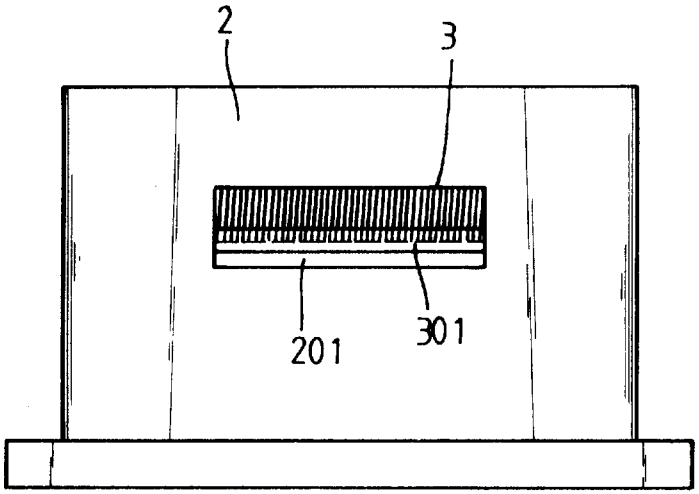
FIG. 6 is a plane view showing the application of the silencer as shown in FIGS. 4 and 5.
Figure 7:
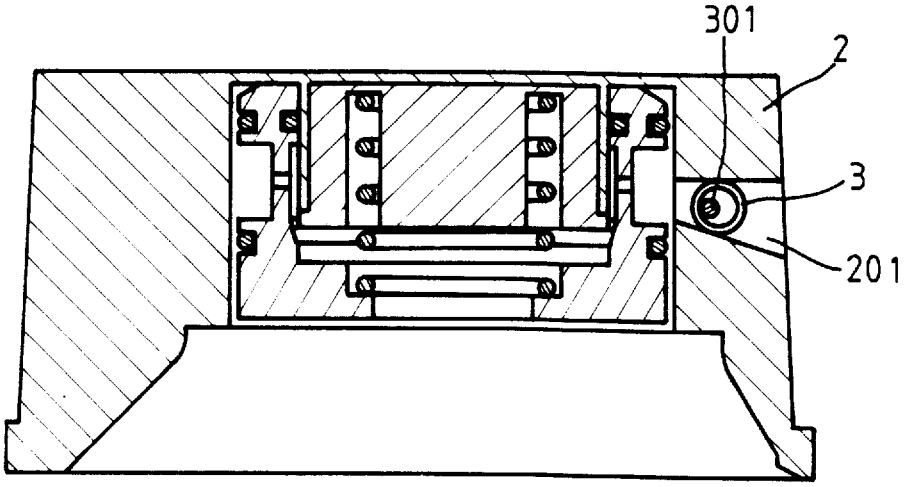
FIG. 7 is an exploded view showing another application of the silencer as shown in FIGS. 4–6.

Referring next to FIGS. 4–6, the cover 2 includes an air outlet 201 and includes two holes 21 for engaging with a rod 301 which is engaged in the outlet 201. The silencer 3 may be disposed in the outlet 201 directly and engaged with the rod 301 which may prevent the silencer 3 from disengaging from the cover 2. Alternatively, the rod 301 may be engaged through the silencer 3 which is a coil spring as shown in FIG. 7. The pressurized air flowing out of the outlet 201 may flow through the silencer 3 such that the silencer 3 may also be used for reducing the noise that may be generated by the pressurized air.

Accordingly, the stapler in accordance with the present invention includes a silencer for reducing the noise of the exhaust air.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapler cover comprising:

a cover body including an outlet for allowing pressurized air to flow out of said cover body of said stapler cover, and means for silencing the pressurized air flowing through said outlet, said silencing means including a coil spring, said cover body including at least one stop member engaged with said coil spring and for retaining said coil spring in place.

2. A stapler cover comprising:

a cover body including an outlet for allowing pressurized air to flow out of said cover body of said stapler cover, means for silencing the pressurized air flowing through said outlet, said silencing means including a coil spring, and a wire engaged through said coil spring for retaining said coil spring in place.

3. A stapler cover comprising:

a cover body including an outlet for allowing pressurized air to flow out of said cover body of said stapler cover, and means for silencing the pressurized air flowing through said outlet, said silencing means including a coil spring disposed in said outlet and a rod for securing said coil spring to said cover body.

4. A cover according to claim 3, wherein said rod is engaged through said coil spring.

5. A cover according to claim 3, wherein said cover body includes a plurality of openings, and a cap secured to said cover body, said outlet is formed in said cap, said silencing means is disposed between said openings and said outlet and includes a plurality of apertures for allowing the pressurized air to flow through said outlet and for silencing the pressurized air.

* * * * *